US008443599B2

(12) United States Patent
Watanabe et al.

(10) Patent No.: US 8,443,599 B2
(45) Date of Patent: May 21, 2013

(54) THERMOACOUSTIC APPARATUS

(75) Inventors: Yoshiaki Watanabe, Kyoto (JP); Shinichi Sakamoto, Kyoto (JP); Hideo Yoshida, Kyoto (JP); Yosuke Imamura, Kyoto (JP)

(73) Assignee: The Doshisha, Kyoto-shi (JP)

( * ) Notice: Subject to any disclaimer, the term of this patent is extended or adjusted under 35 U.S.C. 154(b) by 887 days.

(21) Appl. No.: 12/439,653

(22) PCT Filed: Feb. 21, 2007

(86) PCT No.: PCT/JP2007/053155
§ 371 (c)(1),
(2), (4) Date: Oct. 16, 2009

(87) PCT Pub. No.: WO2008/029521
PCT Pub. Date: Mar. 13, 2008

(65) Prior Publication Data

US 2010/0064680 A1 Mar. 18, 2010

(30) Foreign Application Priority Data

Sep. 2, 2006 (JP) ..... 2006-238378

(51) Int. Cl.
*F01B 29/10* (2006.01)
*F03G 7/00* (2006.01)

(52) U.S. Cl.
USPC ..... 60/520; 60/521; 60/522; 62/6

(58) Field of Classification Search
USPC ..... 60/520–522, 721; 62/6, 335
See application file for complete search history.

(56) References Cited

U.S. PATENT DOCUMENTS 4,114,380 A * 9/1978 Ceperley ..... 60/721
4,355,517 A * 10/1982 Ceperley ..... 60/721

(Continued)

FOREIGN PATENT DOCUMENTS

JP 11-344266 A 12/1999
JP 2000-088378 A 3/2000

(Continued)

OTHER PUBLICATIONS

International Search Report of PCT/JP2007/053155; Mailing Date of Apr. 17, 2007.

*Primary Examiner* — Hoang Nguyen
(74) *Attorney, Agent, or Firm* — Westerman, Hattori, Daniels & Adrian, LLP

(57) ABSTRACT

A thermoacoustic apparatus capable of reducing the time elapsed until an acoustic wave is generated and improving the energy conversion efficiency significantly is provided. In order to solve the above-described issues, in a thermoacoustic apparatus 1 including a pair of heat exchangers 41 and 43 separately set on the high temperature side and on the low temperature side, a second stack 42 which is sandwiched between the heat exchangers 41 and 43 and which has a plurality of transmission paths in the inside, and a loop tube 2 provided with the heat exchangers 41 and 43 and the stack 42, the thermoacoustic apparatus converting acoustic energy generated in the loop tube 2 with an acoustic wave generator 3 to thermal energy by using the heat exchangers 41 and 43 and the stack 42, a narrow portion 21 in which the inner diameter is relatively reduced is disposed at a position at which the particle velocity of a standing wave generated in the loop tube 2 is in the vicinity of a maximum. Furthermore, in order to reduce the particle velocity, a branch tube **2*e* is connected at a position at which the particle velocity of a standing wave generated in the loop tube 2** is in the vicinity of a minimum.

6 Claims, 18 Drawing Sheets

U.S. PATENT DOCUMENTS

| | | | | |
|---|---|---|---|---|
| 5,996,345 | A * | 12/1999 | Hofler | 60/517 |
| 6,032,464 | A | 3/2000 | Swift et al. | |
| 6,164,073 | A * | 12/2000 | Swift et al. | 60/721 |
| 6,658,862 | B2 * | 12/2003 | Swift et al. | 62/6 |
| 2006/0185370 | A1 | 8/2006 | Watanabe et al. | |

FOREIGN PATENT DOCUMENTS

| | | | |
|---|---|---|---|
| JP | 2005-188846 | A | 7/2005 |
| JP | 2006-105009 | A | 4/2006 |
| JP | 2006-189219 | A | 7/2006 |

* cited by examiner

THERMOACOUSTIC APPARATUS

TECHNICAL FIELD

The present invention relates to an apparatus for conducting energy conversion between thermal energy and acoustic energy through the use of thermoacoustic effect. In particular, it relates to, for example, a thermoacoustic apparatus in which energy conversion and energy exchange, temperature control, acoustic control, and the like are conducted efficiently through the use of thermoacoustic effect.

BACKGROUND ART

Previously, thermoacoustic apparatuses have been known as apparatuses for conducting energy conversion between thermal energy and acoustic energy. For example, apparatuses shown in Patent Document 1 and Patent Document 2, as described below, have been known.

A thermoacoustic apparatus shown in this Patent Document 1 will be described. As shown in FIG. 17, this thermoacoustic apparatus is provided with a loop tube 200 having a hollow portion in the inside, an acoustic wave generator 300 for generating an acoustic wave through self excitation in the loop tube 200, and an acoustic heat exchanger 400 for converting the acoustic energy to the thermal energy. These acoustic wave generator 300 and the acoustic heat exchanger 400 are composed of a stack 303 sandwiched with a pair of metal heat exchangers 301 and 302 and a stack 403 sandwiched with a pair of metal heat exchangers 401 and 402 and are attached in the loop tube 200 individually. These heat exchangers 301, 302, 401, and 402 have a plurality of holes, grids, or the like for passing the acoustic wave through the inside and are configured in such a way that heat can be input from or output to the outside of the loop tube 200. Among these heat exchangers, the upper heat exchanger 301 on the acoustic wave generator 300 side is set at, for example, 700° C. to 800° C. by inputting factory waste heat, automobile waste heat, or the like from the outside. The lower heat exchanger 302 and the upper heat exchanger 401 on the acoustic heat exchanger 400 side are set at relatively low temperatures. For example, the temperature is set at about 18° C. to 20° C. by circulating water in the surroundings. On the other hand, the stacks 303 and 403 disposed in the acoustic wave generator 300 and the acoustic heat exchanger 400 are formed from ceramic, a resin, a metal, or the like and have configurations in which a plurality of transmission paths having very small diameters are disposed along an axis direction of the loop tube 200. When heat is applied to the heat exchanger 301 of the thermoacoustic apparatus having the above-described configuration, an acoustic wave with a plurality of wavelengths is generated through self excitation after a while, and a stable standing wave and a traveling wave are generated in the loop tube 200 after a lapse of a certain time. The acoustic energy due to the standing wave and the traveling wave is transferred along the loop tube 200 to the acoustic heat exchanger 400 side and expands or shrinks a working fluid in the stack 403 there. The thermal energy released from or absorbed by the working fluid because of the expansion or shrinkage is transferred along a wall surface in the stack in a direction reverse to a transfer direction of the acoustic energy. The heat of the heat exchanger 402 is thereby drawn out so that the heat exchanger 402 is cooled. The heat resulting from cooling is output to the outside so as to cool an object to be cooled.

Furthermore, regarding such a thermoacoustic apparatus, an apparatus for improving the energy conversion efficiency has also been proposed. For example, in Patent Document 2 described below, as shown in FIG. 18, a thermoacoustic apparatus having a narrow portion 10, in which the inner diameter of a loop tube is made relatively smaller than those of the other portions is proposed. In FIG. 18, reference numeral 20 denotes an acoustic wave generator and reference numeral 30 denotes an acoustic heat exchanger in which a temperature gradient is generated between heat exchangers because of the acoustic wave output from the acoustic wave generator 20. As described above, in the case where the narrow portion 10 is disposed in the loop tube, an acoustic wave stream and a mass stream generated in the loop tube 200 can be reduced to some extent. Consequently, transfer of heat in the loop tube is reduced and the energy conversion efficiency can be improved.

[Patent Document 1] Japanese Unexamined Patent Application Publication No. 2005-274100

[Patent Document 2] Japanese Unexamined Patent Application Publication (Translation of PCT Application) No. 2002-535597

DISCLOSURE OF INVENTION

Problems to be Solved by the Invention

Incidentally, in the case where a relatively long narrow portion as shown in Patent Document 2 described above is disposed, the transfer of heat is reduced and the energy conversion efficiency can be improved after the acoustic wave is generated, but the energy conversion cannot be conducted until the standing wave and the traveling wave are generated in the loop tube. At this time, if rapid generation of acoustic wave through self excitation in the thermoacoustic apparatus, as shown in FIG. 17, is intended, it is favorable that a high temperature gradient is formed by inputting high heat to a heat exchanger on the acoustic wave generator side. However, there is a problem in that the input of such high heat leads to a reduction in energy conversion efficiency.

Accordingly, the present invention has been made in consideration of the above-described issues. It is an object of the present invention to provide a thermoacoustic apparatus capable of reducing the time elapsed until an acoustic wave is generated and improving the energy conversion efficiency significantly.

Means for Solving the Problems

That is, in order to solve the above-described issues, a thermoacoustic apparatus according to the present invention is provided with an acoustic wave generator for generating an acoustic wave, an acoustic heat exchanger including a pair of heat exchangers set on the high temperature side and on the low temperature side and a stack having a plurality of transmission paths in the inside, and a hollow member including the above-described acoustic wave generator and the acoustic heat exchanger, the thermoacoustic apparatus converting acoustic energy generated in the hollow member to thermal energy by using the above-described acoustic heat exchanger, wherein a particle velocity acceleration portion for forcedly accelerating the particle velocity of the acoustic wave by reducing the inner diameter of the hollow member is disposed at a midpoint position between the acoustic wave generator and the acoustic heat exchanger in the hollow member or/and a particle velocity reduction portion for forcedly reducing the particle velocity of the acoustic wave generated in the hollow member is disposed in the vicinity of the acoustic heat exchanger in the hollow member.

Preferably, the hollow member is formed from a loop tube.

Consequently, in the case where the particle velocity acceleration portion is disposed, the particle velocity at that point can be made relatively larger than the particle velocities at other points, and the position of a node of the sound pressure (antinode of particle velocity) can be set forcedly so that a stable acoustic wave can be generated rapidly. Alternatively, in the case where the particle velocity reduction portion for reducing the particle velocity is disposed, the position thereof can be forcedly set at an antinode of the sound pressure (node of particle velocity). Consequently, a stable acoustic wave can be generated rapidly. Incidentally, the "position at which the particle velocity is a maximum" or the "position at which the particle velocity is a minimum" here refers to not only the position at which the particle velocity is strictly the maximum or the minimum" but also positions at a distance within the range of $\lambda/4$ from the center position at which the particle velocity is the maximum or the minimum, where $\lambda$ represents a maximum wavelength of the acoustic wave generated in the hollow member.

In such an invention, the particle velocity acceleration portion is configured to be slidable along the inside of the hollow member.

Furthermore, the particle velocity reduction portion is formed from an opening portion of a branch tube connected to the hollow member.

Consequently, the inner diameter of the connection portion of the hollow member and the opening portion increases and, thereby, the particle velocity becomes small relatively. This position can be forcedly set at the position of an antinode of the sound pressure.

Then, in the case where this branch tube is connected, the length of this branch tube is specified to be a length suitable for generating, in the branch tube, the same wavelength as an integral multiple of the one-quarter wavelength of the acoustic wave generated in the hollow member.

Consequently, the wavelength of the acoustic wave generated in the hollow member can be made an integral multiple of the one-quarter wavelength of the acoustic wave generated in the branch tube, and a stable acoustic wave can be generated rapidly in the hollow member through the use of a resonance phenomenon.

Alternatively, in the case where the particle velocity reduction portion is disposed, a transmission path blocking portion for blocking transmission of the working fluid is disposed with respect to the stack. Here, in the case where the transmission path blocking portion is disposed with respect to the stack, it may be disposed in the stack or be disposed at an end portion of the stack.

In this case as well, the energy conversion efficiency can be improved by forcedly setting the position of the sound pressure.

Alternatively, in the case where the particle velocity reduction portion is disposed, a blocking component for blocking the hollow portion of the hollow member is disposed in the hollow member. Here, the blocking component may be a tabular member for blocking the hollow portion or be a film member in the shape of a thin film.

In such a case as well, the position of the blocking member can be forcedly set at the position at which the particle velocity is a minimum, and a stable acoustic wave is generated rapidly, so that the energy conversion efficiency can be improved.

Advantages

According to the present invention, the particle velocity acceleration portion is disposed and, thereby, the particle velocity at that position can be made relatively larger than the particle velocities of other positions. Consequently, the position of the node of the sound pressure (antinode of particle velocity) can be forcedly set, so that a stable acoustic wave can be generated rapidly. Alternatively, the particle velocity reduction portion for forcedly reducing the particle velocity is disposed and, thereby, the position thereof can be forcedly set at the position of the antinode of the sound pressure (node of the particle velocity). Consequently, a stable acoustic wave can be generated rapidly.

FIRST EMBODIMENT

A thermoacoustic apparatus 1 according to a first embodiment of the present invention will be described below with reference to drawings.

As shown in FIG. 1, the thermoacoustic apparatus 1 in the present embodiment includes an acoustic wave generator 3 and an acoustic heat exchanger 4 in the inside of a loop tube 2 configured to take on a nearly rectangular shape as a whole. A standing wave and a traveling wave are generated by the acoustic wave generator 3, and the second low-temperature-side heat exchanger 43 of the acoustic heat exchanger 4 is cooled by propagating the standing wave and the traveling wave to the acoustic heat exchanger 4 side. Then, as a feature of the present embodiment, a narrow portion 21 having an inner diameter relatively smaller than those of other portions is disposed in the loop tube 2 and, thereby, the standing wave is generated rapidly. The thermoacoustic apparatus 1 in the present embodiment will be described below in detail.

The loop tube 2 constituting the thermoacoustic apparatus 1 is configured to include a pair of linear tube portions 2*a* disposed in the vertical direction relative to the ground, arm portions 2*c* disposed at upper and lower corner portions of the linear tube portions 2*a*, and connection tube portions 2*b* connected to the linear tube portions 2*a* with the arm portions 2*c* therebetween, each being composed of a hollow metal pipe or the like. These linear tube portions 2*a*, arm portions 2*c*, and connection tube portions 2*b* have nearly equal inner diameters except the narrow portion 21 having the reduced inner diameter and are connected to each other through flanges or the like, although not shown in the drawing. On the other hand, the narrow portion 21 has a narrow path 22 having an inner diameter relatively smaller than those of other sections and is set to be a node of the sound pressure of the acoustic wave generated in the loop tube 2 by increasing the particle velocity in the narrow path 22. It is favorable that such a narrow portion 21 is disposed nearly in the vicinity of the midpoint position between the acoustic wave generator 3 and the acoustic heat exchanger 4. In the case where the narrow portion 21 is disposed at such a position, a standing wave composed of one wave component in which antinodes of sound pressure are the position of the acoustic wave generator 3 and the position of the acoustic heat exchanger 4 can be generated easily. This state is explained with reference to FIG. 6. FIG. 6 is a diagram showing a loop tube 2 in a linearly opened state. The acoustic wave generator 3 is disposed on the left side, the acoustic heat exchanger 4 is disposed on the right side, and the narrow portion 21 is disposed at the midpoint position therebetween. Incidentally, in the drawing, a thick solid line indicates the sound pressure distribution of one-wave standing wave and a broken line indicates the particle velocity distribution of the same one-wave standing wave correspondingly. In the drawing, since an acoustic wave is output from the acoustic wave generator 3, the sound pressure at this position is the highest. Furthermore, the particle velocity is the largest in the portion in which the narrow portion 21 is disposed because the narrow path 22 is disposed. Consequently, the position of the acoustic wave generator 3 becomes the position of an antinode of the sound pressure, and the position at which the narrow portion 21 is disposed becomes the position of a node of the sound pressure (antinode of particle velocity). At this time, if it is assumed that an acoustic wave composed of two wave components in which antinodes of sound pressure are the position of the acoustic wave generator 3 and the position of the acoustic heat exchanger 4 is generated, as indicated by a thin solid line in FIG. 6, the portion in which the narrow portion 21 is disposed becomes an antinode of sound pressure. That is, a contradictory result is led, wherein the particle velocity becomes a minimum at the position at which the narrow portion 21 is disposed. Therefore, in the case where the narrow portion 21 is disposed in the vicinity of the midpoint position between the acoustic wave generator 3 and the acoustic heat exchanger 4, generation of a two-wave (precisely, even wave) standing wave can be prevented. However, in this case, if the lengths in the left and right directions of the narrow portion 21 are too large, the position of the node of sound pressure in the standing wave may become unstable. Therefore, it is preferable that the length of the narrow portion 21 is specified to be smaller than one-tenth wavelength of the standing wave. Furthermore, regarding the inner diameter of the narrow path 22, as the inner diameter is made smaller, the particle velocity can be made relatively larger than those of the other portions. However, if the inner diameter is made too small, the acoustic wave may be blocked there, or acoustic energy in the loop tube 2 may be converted to thermal energy there. Consequently, it is preferable that the inner diameter is specified to be nearly half the average inner diameter of the other portions.

Incidentally, this narrow portion 21 may cause fluctuations in the energy conversion efficiency significantly depending on the position of disposition. Therefore, in the present embodiment, the position in the loop tube 2 is made changeable. As for a method for changing the position of the narrow portion 21 in the loop tube 2, for example, a method is conceived, in which an elastic resin or the like is wounded around the peripheral portion of the narrow portion 21 formed into a cylindrical shape, and the narrow portion 21 is inserted into the loop tube 2 by being pushed while the elastic resin is shrunk. Consequently, the narrow portion 21 is pushed in up to an optimum position and can be fixed at an appropriate position. In this regard, in the case where the position of the narrow portion 21 is pushed in, it is necessary that the position is changed by a pushing operation inside the loop tube 2. However, this position change can also be conducted through an operation outside the loop tube 2. In an example of such a method, as shown in FIG. 2, a slit portion 23 along an axis direction is disposed in a peripheral portion of the loop tube 2, and a projection piece 24 projected from the narrow portion 21 is exposed at this slit portion 23. Then the position is changed at will by sliding this projection piece 24. At this time, an acoustic wave may leak to the outside from the slit portion 23. Therefore, preferably, the slit portion 23 is sealed with the narrow portion 21 or the slit portion 23 is sealed by using another component.

In this regard, the case where the cylindrical narrow portion 21 is attached is explained with reference to FIG. 1 and FIG. 2. However, in the case where it is not necessary that the position of this narrow portion 21 is changed, for example, as shown in FIG. 3, the narrow portion 21 may be formed by denting a part of a connection tube portion 2*b*. Regarding these narrow portions 21, if other inside portions of the loop tube 2 are sharply inclined, an acoustic wave is reflected there and it may take much time until a standing wave is generated. Therefore, it is preferable that the boundary portions between the narrow portion 21 and the other portions are in a smoothly inclined state.

The acoustic wave generator 3 generates a standing wave and a traveling wave in the loop tube 2 and is configured to include a first high-temperature-side heat exchanger 31 and a first low-temperature-side heat exchanger 33 and a first stack 32 sandwiched therebetween in order to generate an acoustic wave through self excitation in the present embodiment. On the other hand, the acoustic heat exchanger 4 converts the acoustic energy based on the acoustic wave generated in the loop tube 2 to thermal energy and is configured to include the second high-temperature-side heat exchanger 41 and the second low-temperature-side heat exchanger 43 and a second stack 42 sandwiched therebetween similarly to the acoustic wave generator 3.

Among them, the first high-temperature-side heat exchanger 31, the first low-temperature-side heat exchanger 33, the second high-temperature-side heat exchanger 41, and the second low-temperature-side heat exchanger 43 are formed from metal members and inside surfaces thereof are provided with transmission paths which are a plurality of holes for transmitting the standing wave and the traveling wave. Among these heat exchangers, the first high-temperature-side heat exchanger 31 is set at, for example, about 30° C. to 700° C. through heating by inputting an electric power, waste heat, or the like from the outside. On the other hand, the first low-temperature-side heat exchanger 33 is set at a temperature of, for example, 18° C. to 20° C. relatively lower than that of the first high-temperature-side heat exchanger 31 by circulating water in the surroundings.

The first stack 32 and the second stack 42 take on cylindrical shapes having outer diameters which touch the inner wall of the loop tube 2 and are formed from a raw material containing ceramic, sintered metal, gauze, nonwoven metal fabric, or nonmetallic fibers. Furthermore, a plurality of transmission paths 34 and 44 penetrating in the axis direction of the loop tube 2 are disposed in the inside. The transmission paths 34 and 44 may be paths linearly formed from honeycomb-like or grid-like multiholes or be meandering paths which looks as if cotton or the like is compressed.

The acoustic wave generator 3 having the above-described configuration is disposed below the center of the linear tube portion 2*a* while the first high-temperature-side heat exchanger 31 is disposed on the upper side. The acoustic wave generator 3 is disposed below the center of the linear tube portion 2*a* on the grounds that an acoustic wave is generated rapidly through the use of an updraft generated when the first high-temperature-side heat exchanger 31 is heated and that a warm working fluid generated when the first high-temperature-side heat exchanger 31 is heated is prevented from entering the first stack 32. A large temperature gradient is formed in the first stack 32 by preventing the warm working fluid from entering the first stack 32, as described above.

On the other hand, the acoustic heat exchanger 4 is disposed at a distance of about L/2 from the acoustic wave generator 3, where the total circuit length of the loop tube 2 is assumed to be L. In attachment of this acoustic heat exchanger 4 to the loop tube 2, the second high-temperature-side heat exchanger 41, around which water is circulated, is disposed on the upper side and, in addition, the second low-temperature-side heat exchanger 43 for outputting low-temperature heat to the outside is disposed on the lower side. Then, as shown in FIG. 6, the distance between the acoustic wave generator 3 and the acoustic heat exchanger 4 is specified to be about L/2, and the narrow portion 21 is attached at a midpoint position between the acoustic wave generator 3 and the acoustic heat exchanger 4, that is, the position at a distance of about L/4 from the acoustic wave generator 3. Consequently, antinodes of the acoustic wave are set at the position of the acoustic wave generator 3 and the position of the acoustic heat exchanger 4 and, in addition, the node of the sound pressure is specified to be the position of the narrow portion 21.

The operation of the thermoacoustic apparatus 1 having the above-described configuration will be described below.

In the case where high heat is applied to the first high-temperature-side heat exchanger 31 on the acoustic wave generator 3 side and, in addition, the first low-temperature-side heat exchanger 33 is set at low temperatures by circulating water in the surroundings, a temperature gradient is formed between the first high-temperature-side heat exchanger 31 and the first low-temperature-side heat exchanger 33. Then, as shown in FIG. 4, a working fluid in the transmission paths 34 of the first stack 32 is circulated in the manner of "compression→heating→expansion→cooling" and repeats a reciprocating motion while conducting heat exchange with wall surfaces constituting the transmission paths. Consequently, an acoustic wave composed of various wavelengths is generated through self excitation from this acoustic wave generator 3.

The thus generated acoustic wave is propagated in the loop tube 2 and vibrates particles of the working fluid. At this time, regarding the narrow portion 21, the inner diameter is relatively smaller than the inner diameter of the surrounding loop tube 2 and, therefore, the particle velocity of the working fluid is larger than those of the other portions. Consequently, the position of this narrow portion 21 can be forcedly set at the position of the antinode of the particle velocity, and among acoustic waves with various wavelengths, an acoustic wave having the antinode of the particle velocity at this position can be generated rapidly.

The thus generated standing wave and traveling wave are transferred as acoustic energy to the acoustic heat exchanger 4 side.

On the acoustic heat exchanger 4 side, the working fluid in the second stack 42 is expanded and compressed on the basis of the standing wave and the traveling wave propagated along the loop tube 2. In the transmission paths 44 of the second stack 42, as shown in FIG. 5, the working fluid repeats the circulation of "compression→cooling→expansion→heating" which is a reverse procedure relative to the thermal circulation in the first stack 32 so as to accumulate the heat in the wall surface of the stack. Then this accumulated thermal energy is transferred in the direction reverse to the transfer direction of the acoustic energy, that is, from the second low-temperature-side heat exchanger 43 to the second high-temperature-side heat exchanger 41. The heat is drawn out from the second low-temperature-side heat exchanger 43 and is transferred to the second high-temperature-side heat exchanger 41 side. The high-temperature heat transferred to the second high-temperature-side heat exchanger 41 side is taken away by a cooling circulator disposed in the surroundings. Along with this, the heat is drawn out gradually to the second high-temperature-side heat exchanger 41 side so that the second low-temperature-side heat exchanger 43 is cooled. Consequently, low-temperature heat of the second low-temperature-side heat exchanger 43 is taken out so as to cool the object to be cooled.

In this manner, according to the above-described embodiment, since the narrow portion 21 is disposed at the midpoint position between the acoustic wave generator 3 and the acoustic heat exchanger 4, the particle velocity at that portion can be increased, that portion is forcedly set at the antinode of the particle velocity in the standing wave, and an acoustic wave can be generated rapidly. Furthermore, in the case where an acoustic wave is generated through self excitation, the acoustic wave can also be generated rapidly even when a temperature difference between the first high-temperature-side heat exchanger 31 and the first low-temperature-side heat exchanger 33 is reduced, and the energy conversion efficiency can be improved by significantly lowering an amount of input heat and an input temperature.

Incidentally, in the above-described first embodiment, the acoustic wave generator 3 and the acoustic heat exchanger 4 are disposed in the loop tube 2. However, the tube is not necessarily in a looped shape, and as shown in FIG. 16, the tube may be a linear tube having end portions or a deformed tube. In FIG. 16, the same reference numerals as those in FIG. 1 indicate the same configurations as those set forth above, and the acoustic wave generator 3 and the acoustic heat exchanger 4 are disposed in the inside of a hollow member. In FIG. 16, this hollow member is linear, but may take on a meandering shape. Furthermore, the end portions of this hollow member may be in a closed state or be in an opened state. Alternatively, a relatively large space, such as a space in a room, may be formed.

Moreover, in the above-described embodiment, the acoustic wave generator 3 for generating an acoustic wave through self excitation is disposed, although not limited to the acoustic wave generator 3 through self excitation. For example, a speaker or the like which forcedly generates an acoustic wave may be employed.

Furthermore, in the above-described embodiment, the narrow portion 21 is disposed at a midpoint position between the acoustic wave generator 3 and the acoustic heat exchanger 4, although not limited to this. The narrow portion 21 may be disposed in the vicinity of an antinode of the particle velocity of the standing wave desired to be generated in the loop tube 2.

In addition, in the above-described embodiment, each of the acoustic wave generator 3 and the acoustic heat exchanger 4 is disposed at one place. However, the number of the unit is not necessarily one, and a plurality of units may be disposed. Alternatively, a plurality of narrow portions 21 may be disposed in a hollow member.

SECOND EMBODIMENT

A second embodiment according to the present invention will be described below with reference to FIG. 7. In the explanation of the present embodiment, the units having the same configurations as those in the first embodiment are indicated by the same reference numerals as those set forth above.

Regarding the thermoacoustic apparatus 1 according to the second embodiment, a branch tube **2*e* is connected to a loop tube 2 including the acoustic wave generator 3 and the acoustic heat exchanger 4, an acoustic wave of an integral multiple of the one-quarter wavelength of the standing wave generated in the loop tube 2 is generated in the branch tube 2*e*, an acoustic wave is generated rapidly through the use of a resonance phenomenon and, in addition, it is made possible to set an opening portion 2*d* of the connection portion at the position of the antinode of the sound pressure. The configuration of the thermoacoustic apparatus 1** in the second embodiment will be described below in detail.

As in the first embodiment, the loop tube 2 is configured to include linear tube portions **2*a*, arm portions 2*c*, and connection tube portions 2*b*. Furthermore, the branch tube 2*e* is connected to the linear tube portion 2***a*. These linear tube portions 2*a*, arm portions 2*c*, connection tube portions 2*b*, and branch tube 2*e* have nearly equal inner diameters, and the narrow portion 21 and the like are not disposed in the configuration. The acoustic wave generator 3 is disposed in the loop tube 2 and, in addition, the acoustic heat exchanger 4 is attached in the branch tube 2*e*. These acoustic wave generator 3 and acoustic heat exchanger 4 are attached with a distance of about L/2. In the present embodiment, the acoustic heat exchanger 4 is attached in the vicinity of the opening portion 2*d* on the branch tube 2*e* side, but may be attached on the linear tube portion 2*a* side, as shown in FIG. 8. Alternatively, it is possible that the acoustic wave generator 3 is attached in the branch tube 2*e* and, in addition, the acoustic heat exchanger 4 is attached in the loop tube 2.

Then, as a feature of the present embodiment, the branch tube 2*e* is connected to the loop tube 2 in the vicinity of the acoustic heat exchanger 4 by disposing the opening portion 2*d*, and a standing wave with the same wavelength as that of the standing wave generated in the loop tube 2 is generated in the inside thereof. An end portion 25 opposite to the opening portion 2*d* of the branch tube 2*e* may be in a closed state, or be in an opened state. In the case where the branch tube 2*e* with the opposite-side end portion 25 being in the closed state is connected, as shown in an upper drawing in FIG. 9, the length is set at n/2 times (n=1, 2, . . . ) the wavelength of the standing wave generated in the loop tube 2. Furthermore, in the case where the branch tube 2*e* with an opposite-side end portion 24 being also in the opened state is connected, as shown in a lower drawing in FIG. 9, the length is set at (2n−1)/4 times (n=1, 2, . . . ) the wavelength of the standing wave generated in the loop tube 2. In the case where the branch tube 2*e* with the closed end portion 25 is connected, the particle velocity at the end portion 25 becomes a minimum, and conversely, the sound pressure becomes a maximum. Consequently, the position of the opening portion 2*d* can be set exactly at the position of the antinode of the sound pressure by setting the length of the branch tube 2*e* at n/2 times the wavelength of the standing wave. On the other hand, in the case where the end portion 25 is opened, the particle velocity at the opened end portion 25 becomes a maximum, and conversely, the sound pressure becomes a minimum (node of sound pressure). Consequently, the position of the opening portion 2*d* can be set exactly at the position of the antinode of the sound pressure by setting the length of the branch tube 2*e* at (2n−1)/4 times the wavelength of the standing wave. Then, the particle velocities at the opening portion 2*d*, which is an intersection of the loop tube 2 and the branch tube 2*e*, can be agreed by connecting the branch tube 2*e* to the vicinity of the position of the antinode of the sound pressure in the standing wave generated in the loop tube 2 and, thereby, an acoustic wave can be generated rapidly through the use of a resonance phenomenon. In the case where thermal energy is taken efficiently from the acoustic wave generated in the loop tube 2, it is preferable that the acoustic heat exchanger 4 is disposed at the position of the antinode of the sound pressure in the standing wave. However, in the case where the acoustic heat exchanger 4 is disposed in the linear tube portion 2*a* of the loop tube 2, as shown in FIG. 8, the branch tube 2*e* and the acoustic heat exchanger 4 cannot be disposed at the position of the antinode at the same time. Consequently, in such a case, it is favorable that the branch tube 2*e* is connected to the close vicinity of the acoustic heat exchanger 4, or as shown in FIG. 10, transmission paths 44 along the axis direction of the loop tube 2 and transmission paths 44 in a direction orthogonal thereto are disposed in a second stack 42, and an opening portion 2*d* is disposed in the direction of the orthogonal-side transmission paths 44 so as to connect to the branch tube 2*e*. In this manner, the positions of the acoustic heat exchanger 4 and the opening portion 2*d* of the branch tube 2*e* can be agreed with the antinode of the sound pressure in the standing wave, and the energy conversion efficiency and reduction in time elapsed until generation of the acoustic wave can be achieved.

The branch tube 2*e* connected to the loop tube 2 may be in a bent state or be in a linear state. In the case where the tube is linear, reflection at the bent portion and the like are eliminated and, therefore, an acoustic wave can be generated rapidly. On the other hand, in the case where the branch tube 2*e* in a bent shape is used, a main linear tube portion is made parallel to the linear tube portion 2*a* of the loop tube 2 and, thereby, the thermoacoustic apparatus 1 itself can be made compact. Furthermore, in the case where a bent branch tube 2*e* is connected, the branch tube 2*e* can also be connected from the outside of the loop tube 2. However, if such a configuration is employed, the thermoacoustic apparatus 1 becomes large. Therefore, as shown in FIG. 11, the entire apparatus can be made compact by connecting the branch tube 2*e* to an enclosed portion inside the loop tube.

In the above-described embodiment, the branch tube 2*e* is attached and, thereby, the position at which the particle velocity becomes a minimum is set. However, the position at which the particle velocity becomes a minimum can be forcedly set by devising the configurations of the first stack 32 and the second stack 42. This configuration will be described with reference to the second stack 42 as an exemplification and FIG. 12. This second stack 42 includes a plurality of transmission paths 44 along an axis direction of the loop tube 2 and, in addition, a transmission path blocking portion 45 is disposed in a direction orthogonal to the axis direction of the loop tube 2 in the transmission paths 44. The above-described transmission path blocking portion 45 blocks the transmission paths 44 by, for example, interposing a film-shaped film member between two stacks divided. This transmission path blocking portion 45 is not limited to the thin film member, but may be any member insofar as the transmission paths 44 are blocked. Since the particle velocity of the working fluid present in the transmission paths 44 can be made zero by disposing the above-described transmission path blocking portion 45, the position of the film of the second stack 42 can be forcedly set at the position of a node of the particle velocity. Consequently, the energy conversion efficiency and reduction in time elapsed until generation of the acoustic wave can be achieved. Furthermore, as shown in FIG. 13 and FIG. 14, this transmission path blocking portion 45 can be disposed on an upper end portion or a lower end portion of the second stack 42. Among them, in the case where the transmission path blocking portion 45 is disposed on the lower end portion side, an acoustic wave transmitted in the loop tube 2 can be input into the transmission paths 44 and, in addition, the position thereof can be exactly set at the position of an antinode of the sound pressure by the transmission path blocking portion 45.

Furthermore, in FIG. 12 to FIG. 14, the transmission path blocking portions 45 are disposed in the stacks 32 and 42 and, thereby, the particle velocity at those positions are forcedly reduced. However, as shown in FIG. 15, a blocking portion 26 which blocks the hollow portion of the loop tube 2 may be disposed in the loop tube. Consequently, in a similar manner, the particle velocity can be forcedly reduced at the position of the blocking portion 26, and a stable standing wave can be generated rapidly. This blocking portion 26 may be formed from any member insofar as the hollow portion of the loop tube 2 is blocked. Components, such as a tabular member and a thin film-shaped film member, which reduce the particle velocity without blocking the acoustic wave relatively can be used. This blocking portion 26 is disposed in the vicinity of the first stack 32 or the second stack 42 or at the position at which the particle velocity is desired to become a minimum. In FIG. 15, the blocking portion 26 is disposed under the second stack 42. However, the blocking portion 26 may be disposed above the second stack 42 or above or under the first stack 32.

According to the above-described second embodiment, the branch tube 2*e* having the opening portion 2*d* for reducing the particle velocity is connected and, thereby, the position of the opening portion 2*d* can be forcedly set at the position of the antinode portion of the sound pressure. Consequently, a standing wave can be generated rapidly. Furthermore, in the present embodiment as well, in the case where an acoustic wave is generated through self excitation, the acoustic wave can be generated rapidly even when a temperature difference between the first high-temperature-side heat exchanger 31 and the first low-temperature-side heat exchanger 33 is reduced, and the energy conversion efficiency can be improved by reducing an amount of input heat.

In the above-described two embodiments, the first embodiment having the configuration in which the narrow portion 21 is disposed and the second embodiment in which the branch tube 2*e* is disposed are explained separately. However, these configurations can be used at the same time. Moreover, the second stack 42 including the transmission path blocking portion 45 may be used together with them.

In the above-described embodiment, high-temperature heat is input into the first high-temperature-side heat exchanger 31, and low-temperature heat is output from the second low-temperature-side heat exchanger 43. However, low-temperature heat may be input from the first low-temperature-side heat exchanger 33, and high-temperature heat may be output from the second high-temperature-side heat exchanger 41, conversely.

REFERENCE NUMERALS

Figure 1:
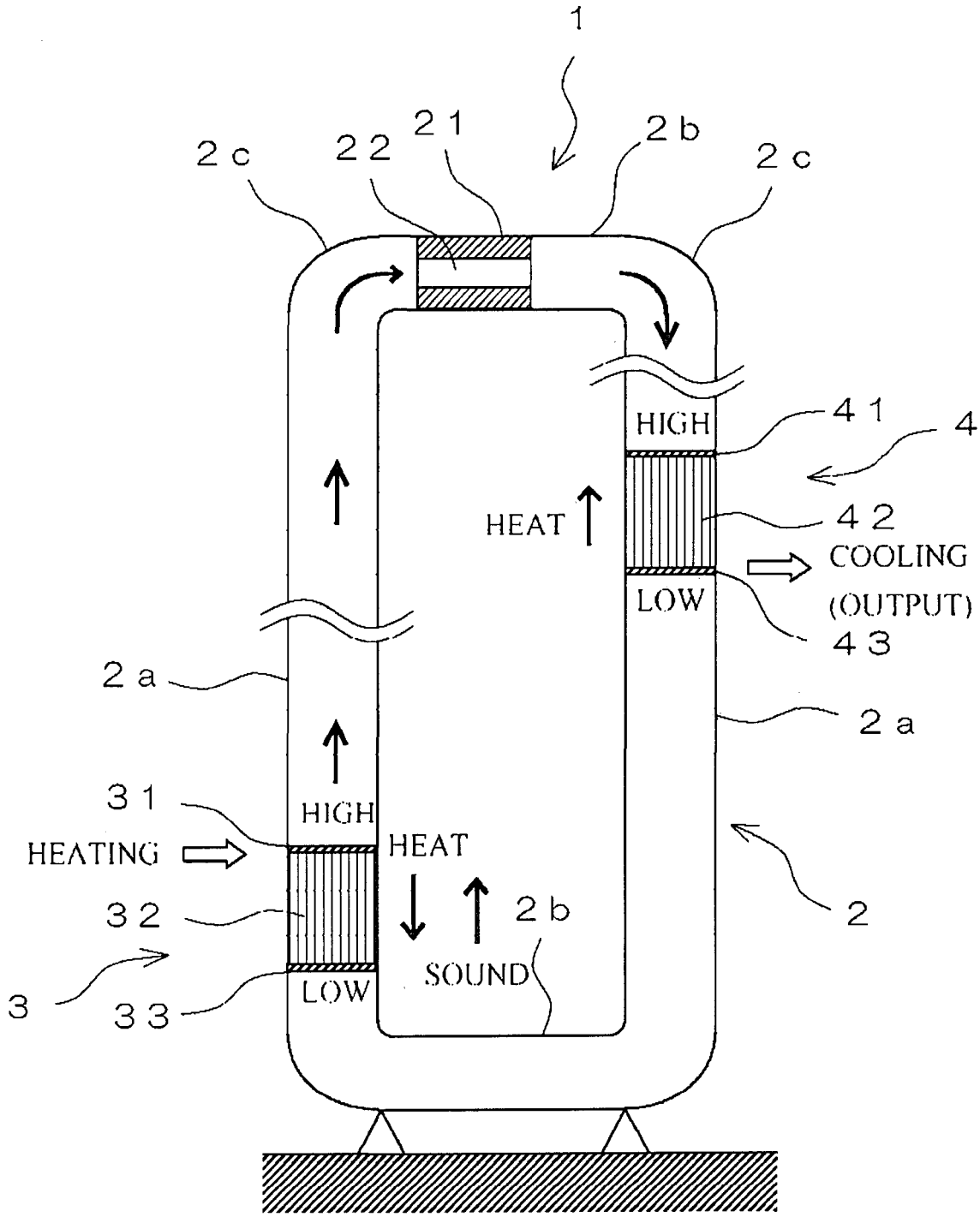
FIG. 1 is a schematic diagram of a thermoacoustic apparatus according to the first embodiment of the present invention.
Figure 2:
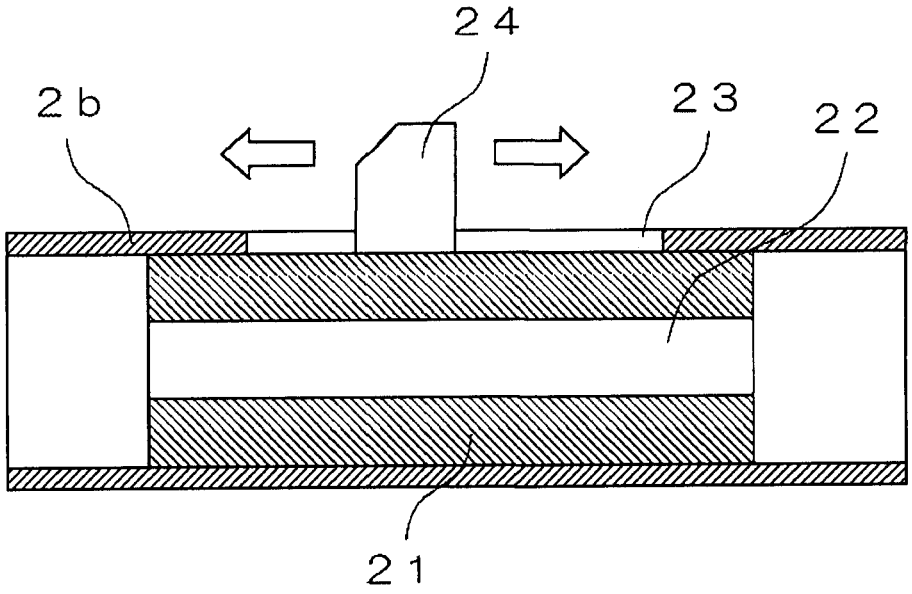
FIG. 2 is a diagram showing a mechanism for sliding a narrow portion in the first embodiment.
Figure 3:
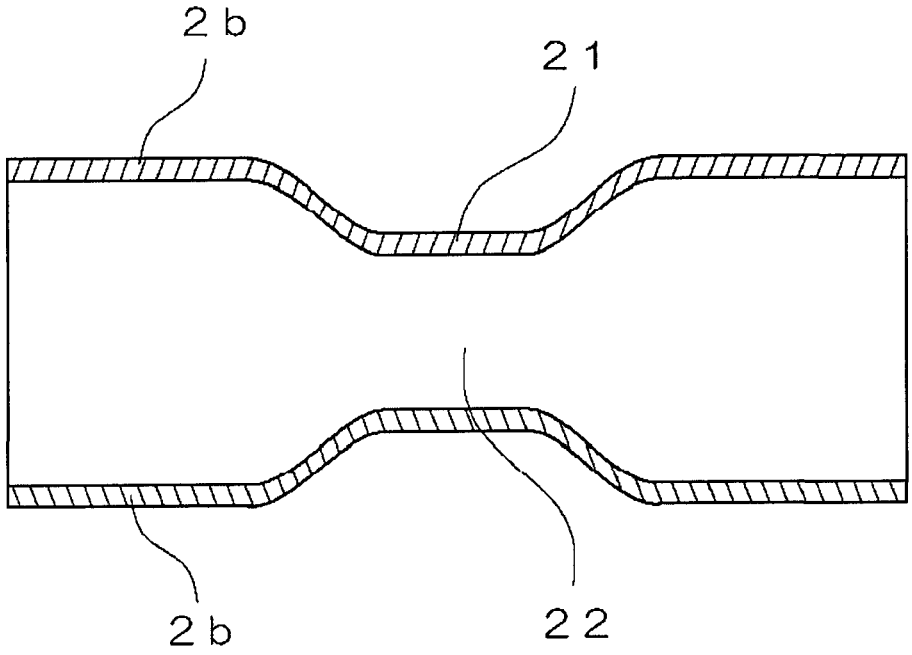
FIG. 3 is a diagram showing a narrow portion in which a connection tube portion is narrowed in the first embodiment.
Figure 4:
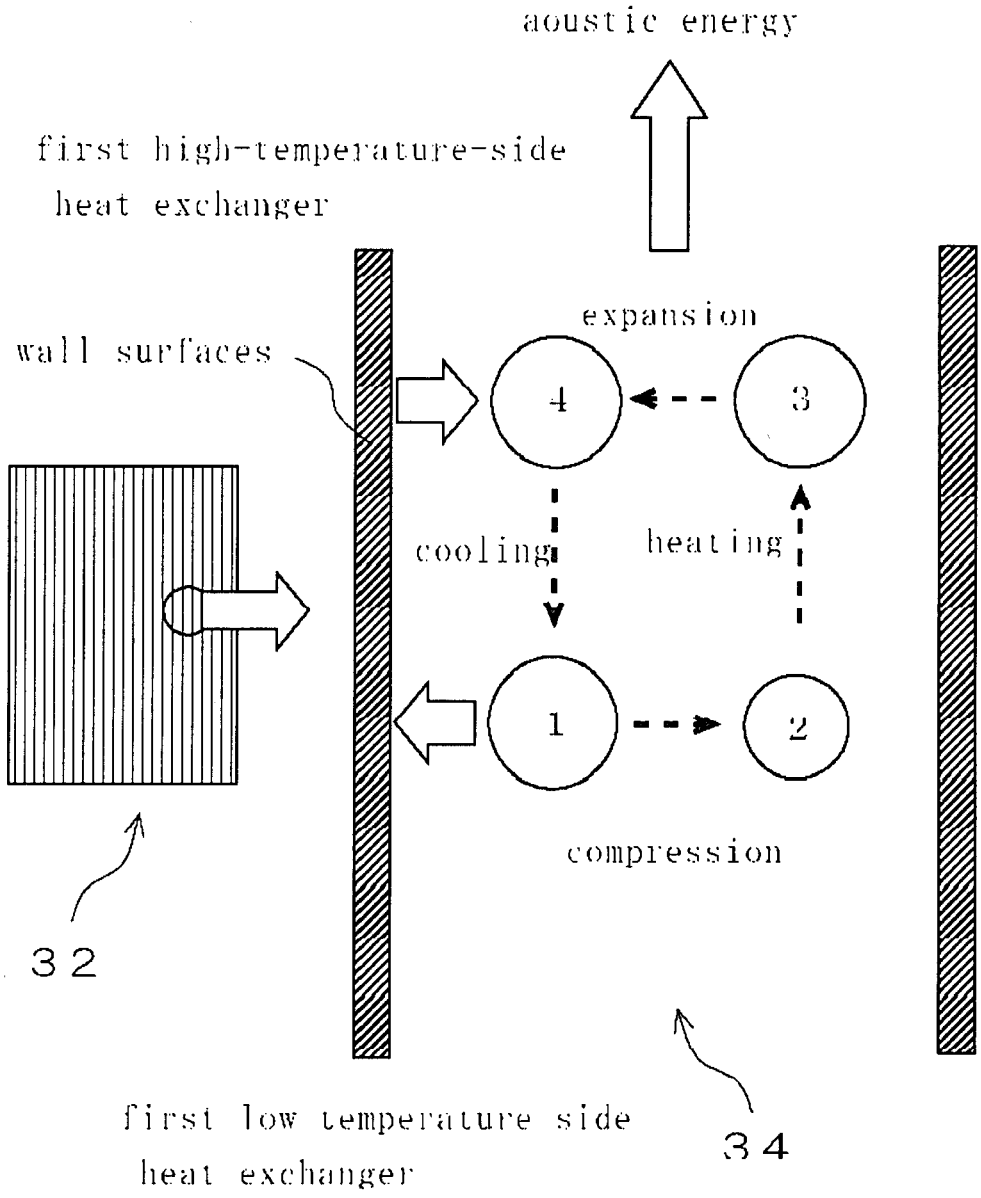
FIG. 4 is a diagram showing a state of a working fluid in a stack in the first embodiment.
Figure 5:
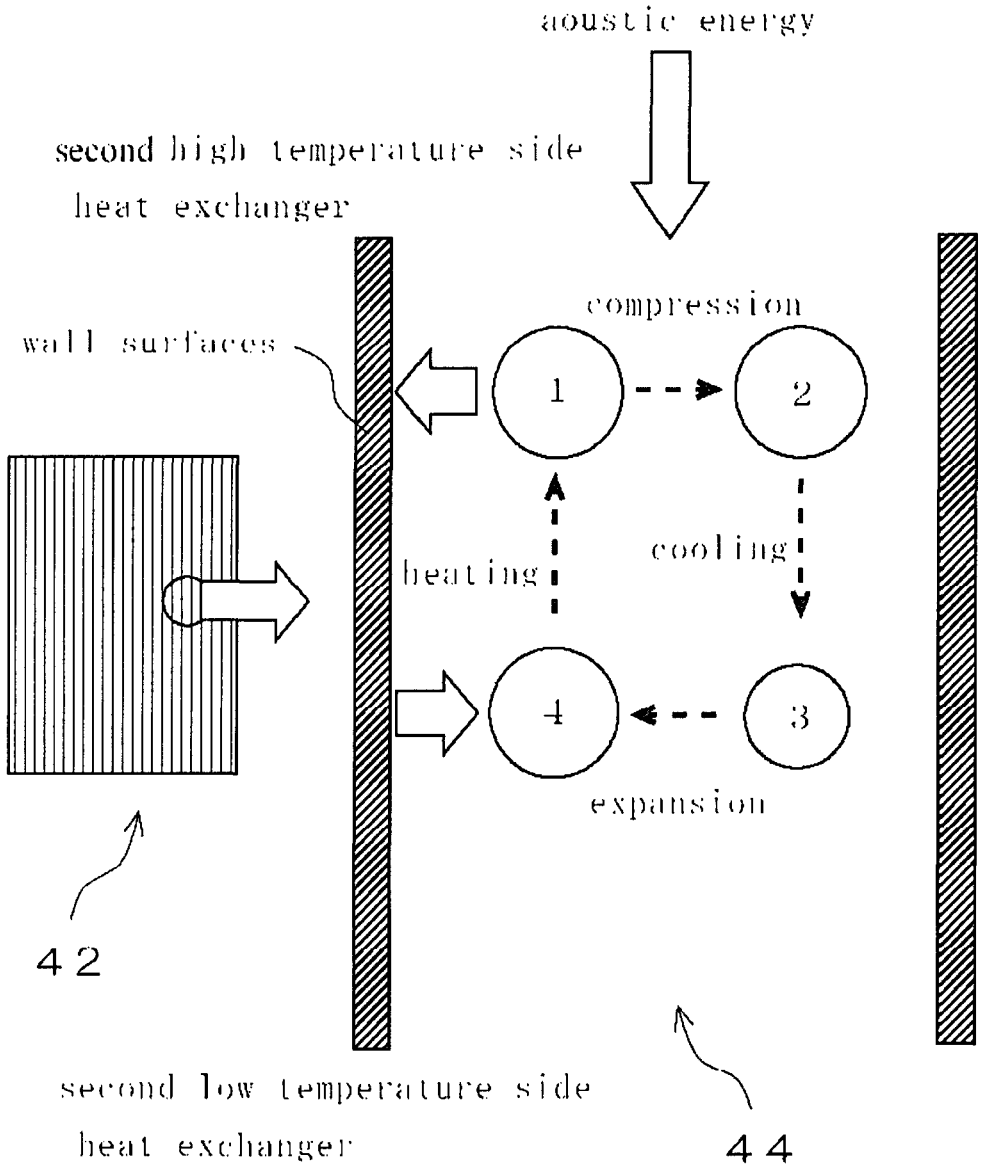
FIG. 5 is a diagram showing a state of a working fluid in a stack in the first embodiment.
Figure 6:
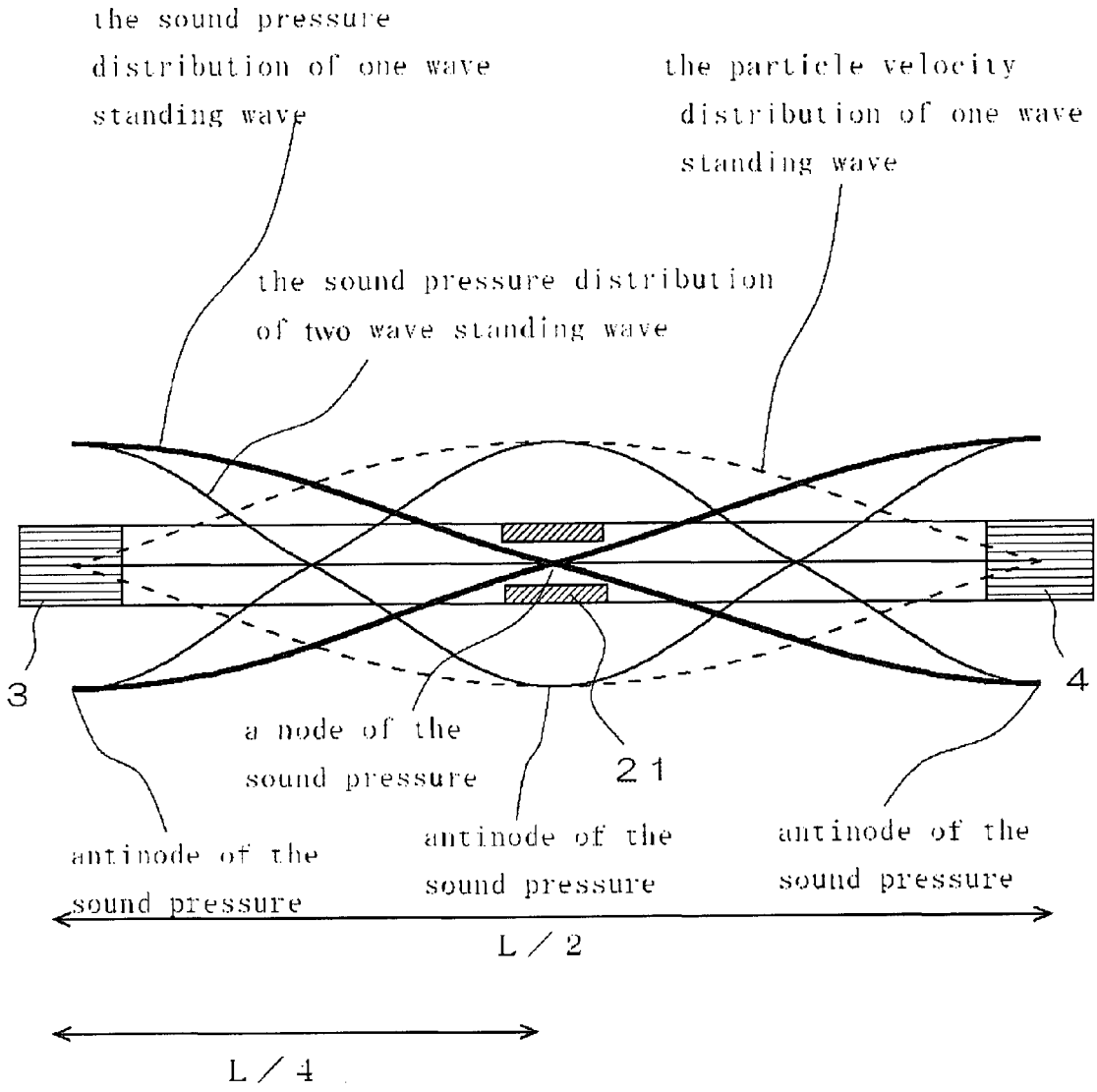
FIG. 6 is a diagram showing a state of a standing wave while a loop tube is developed in the first embodiment.
Figure 7:
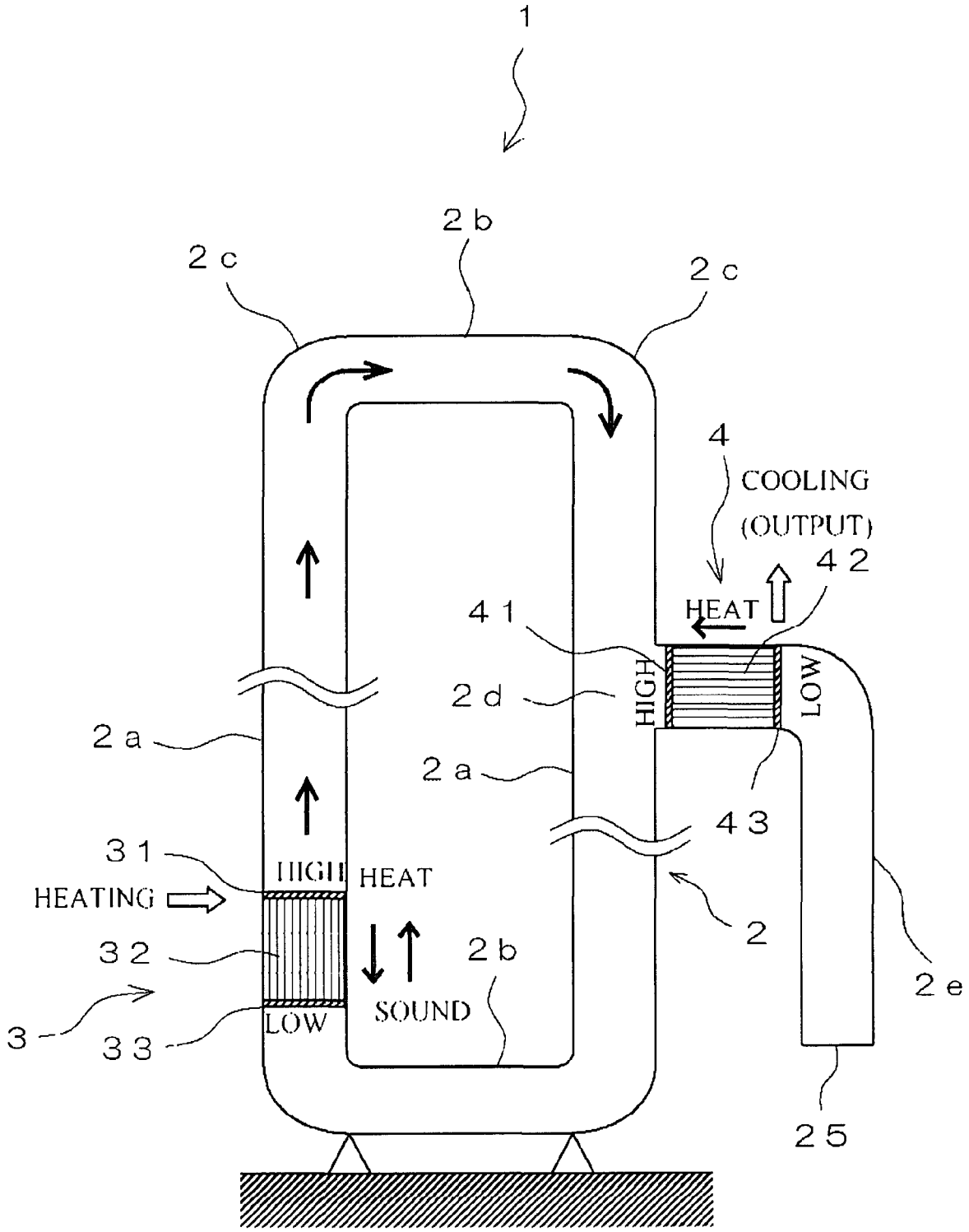
FIG. 7 is a schematic diagram of a thermoacoustic apparatus according to the second embodiment of the present invention.
Figure 8:
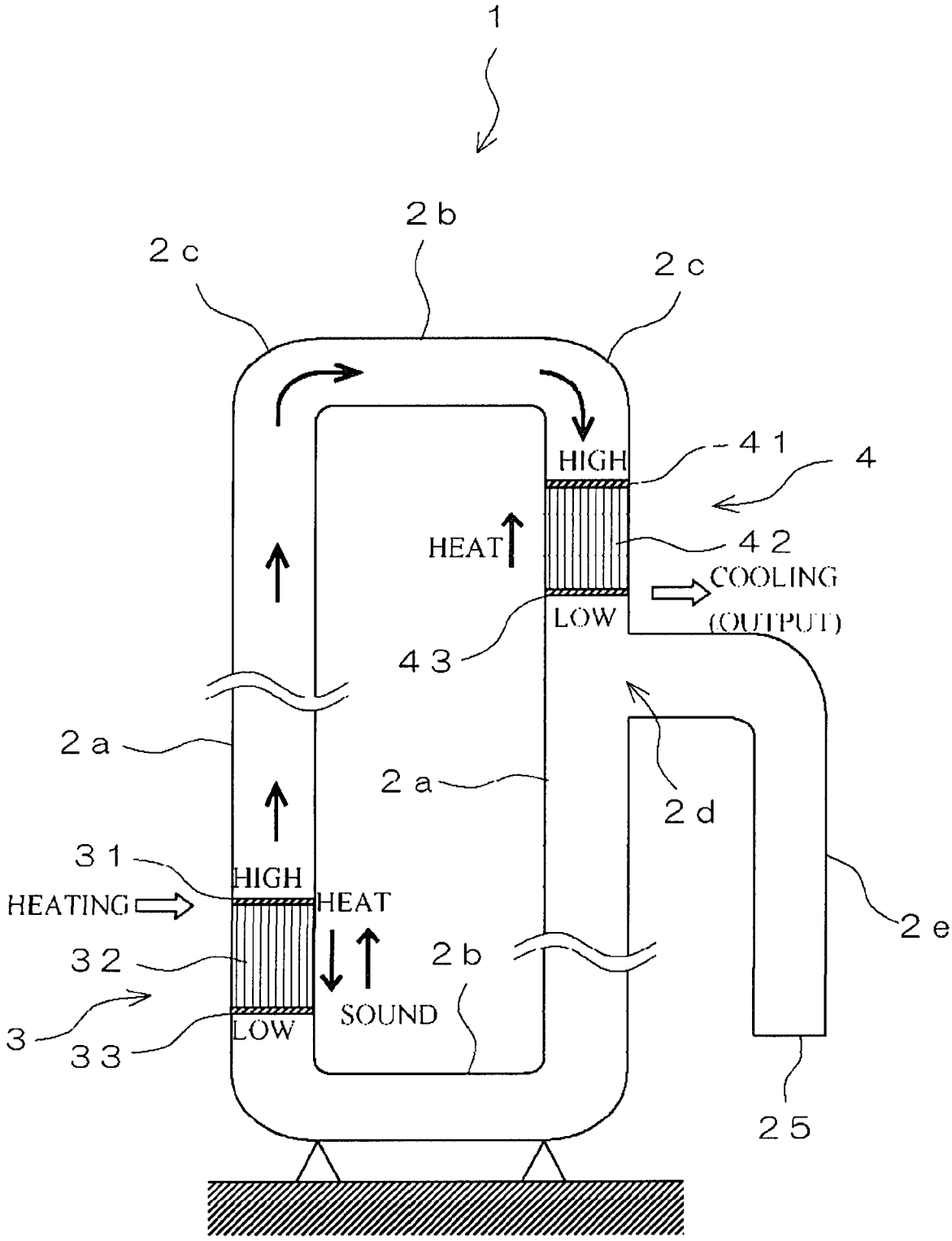
FIG. 8 is a schematic diagram of a thermoacoustic apparatus provided with an acoustic heat exchanger in a linear tube portion in the second embodiment.
Figure 9:
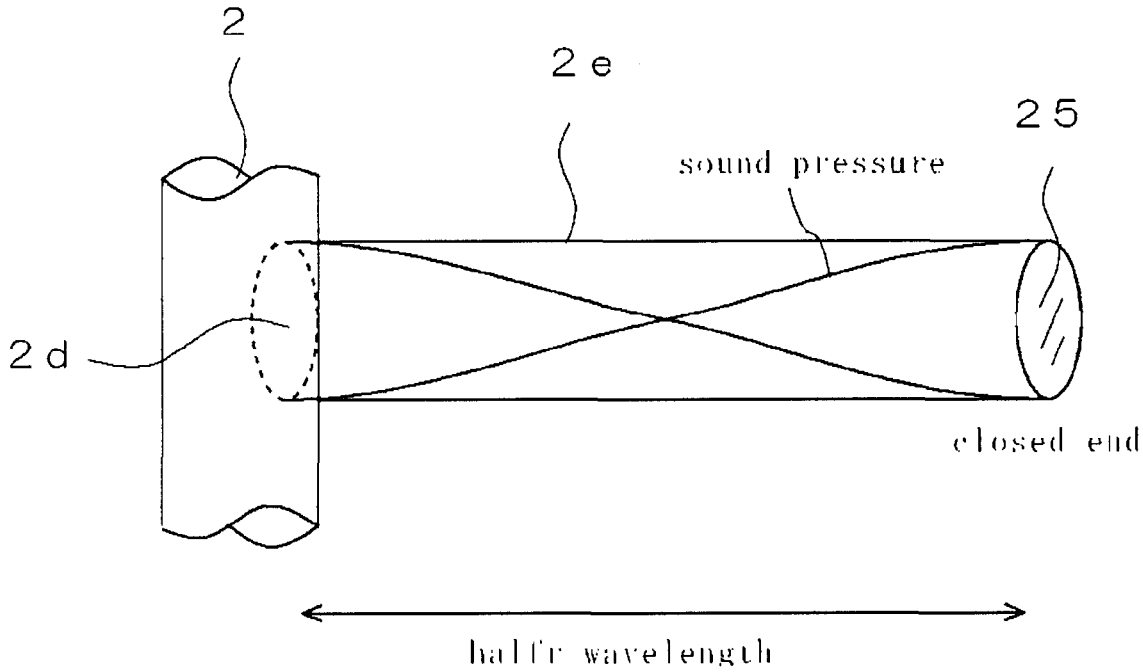
FIG. 9 is a diagram showing a state of an acoustic wave generated in a branch tube in the second embodiment.
Figure 9:
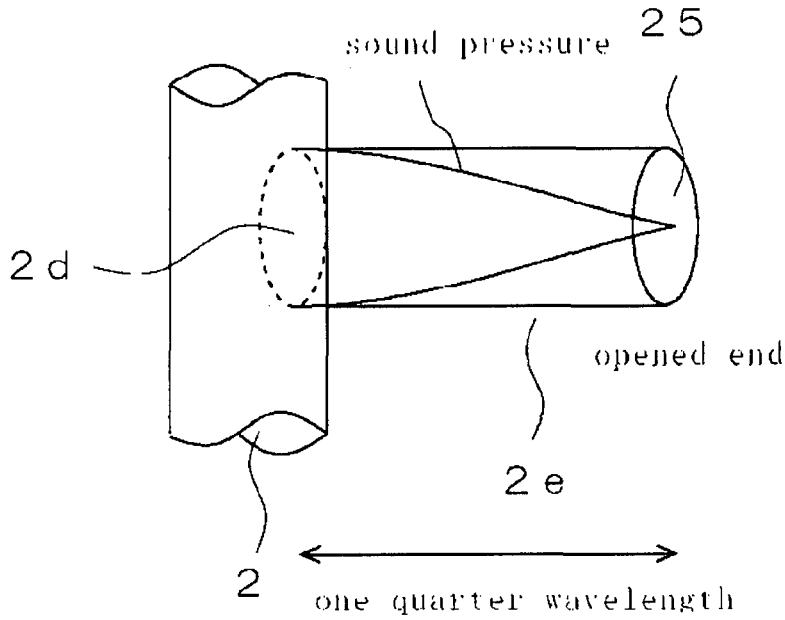
Figure 10:
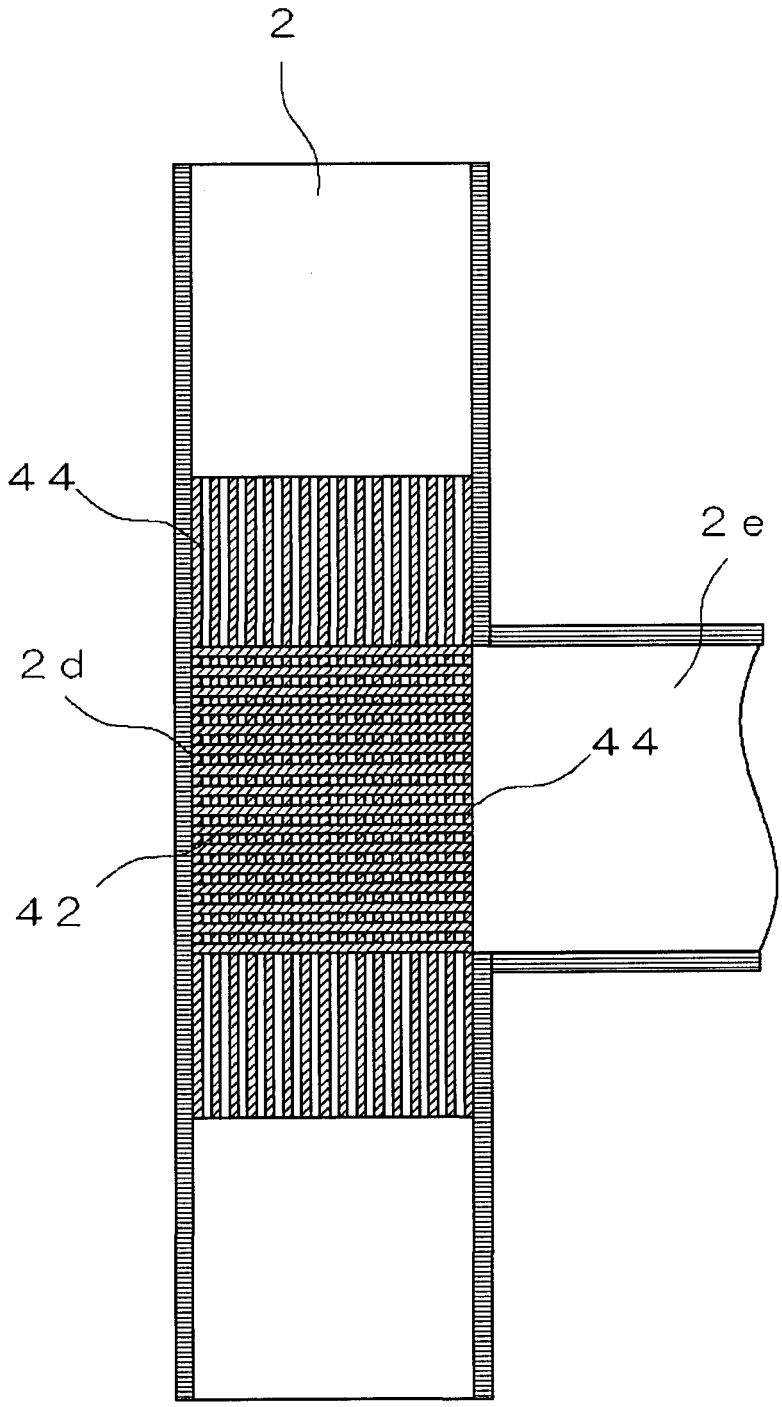
FIG. 10 is a diagram showing another example of a second stack in the second embodiment.
Figure 11:
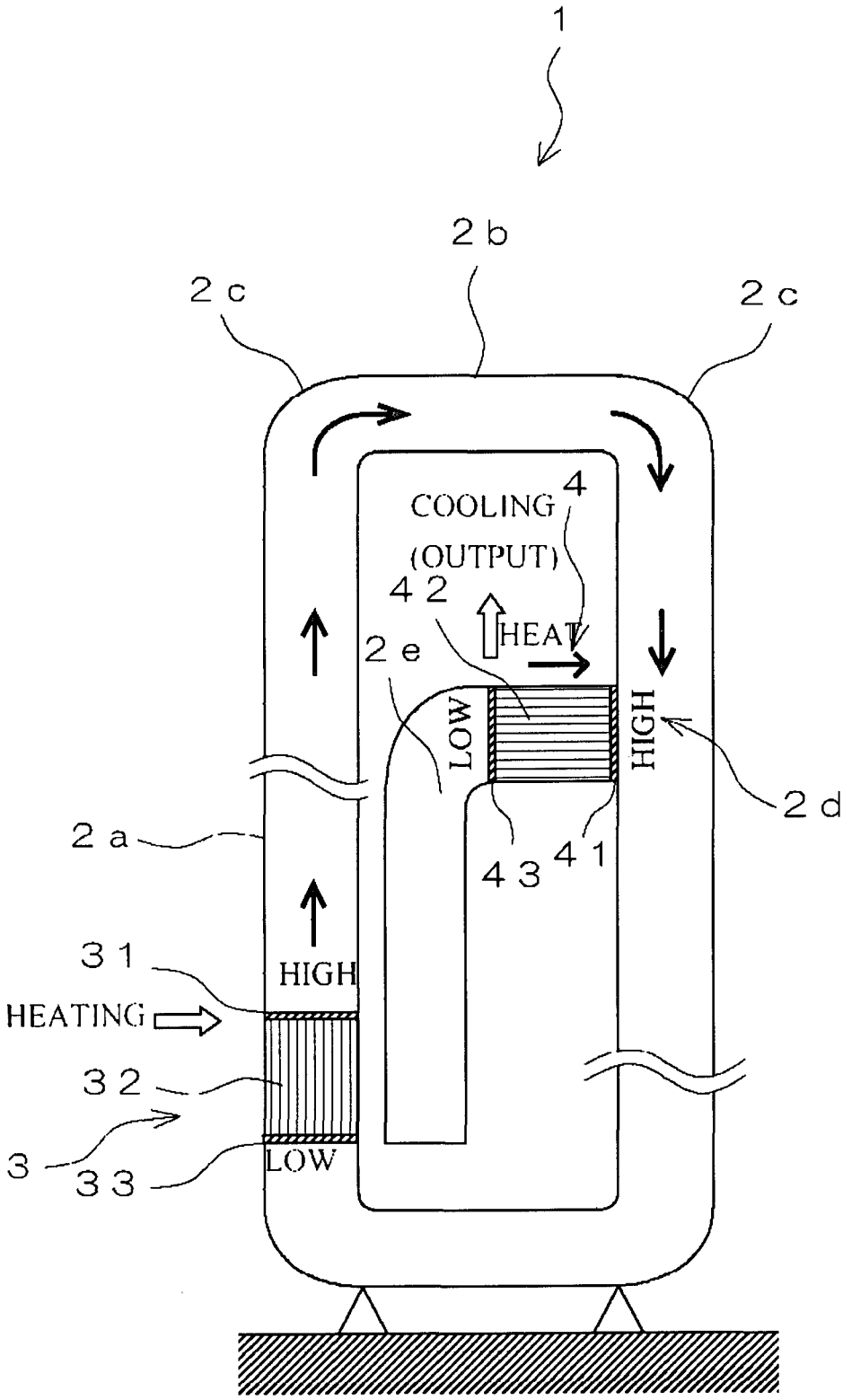
FIG. 11 is a diagram showing a state in which a branch tube is attached inside a loop tube in the second embodiment.
Figure 12:
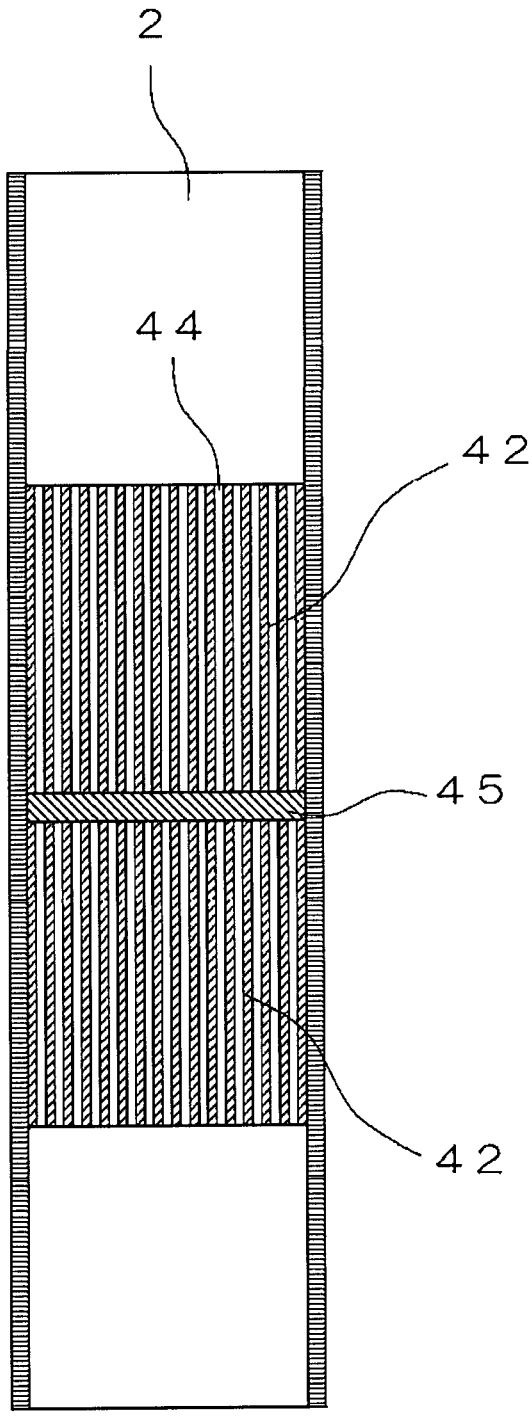
FIG. 12 is a diagram showing a second stack provided with a transmission path blocking portion in the second embodiment.
Figure 13:
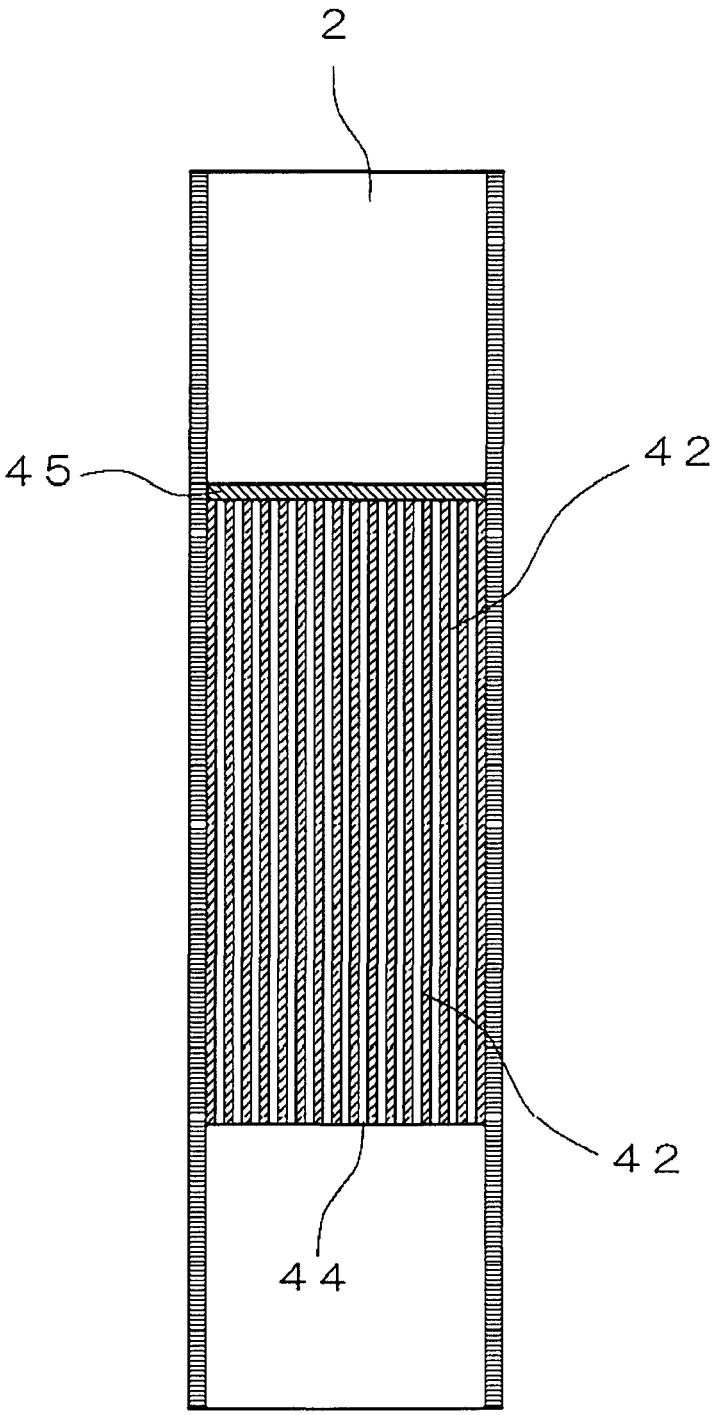
FIG. 13 is a diagram showing a second stack provided with a transmission path blocking portion in the second embodiment.
Figure 14:
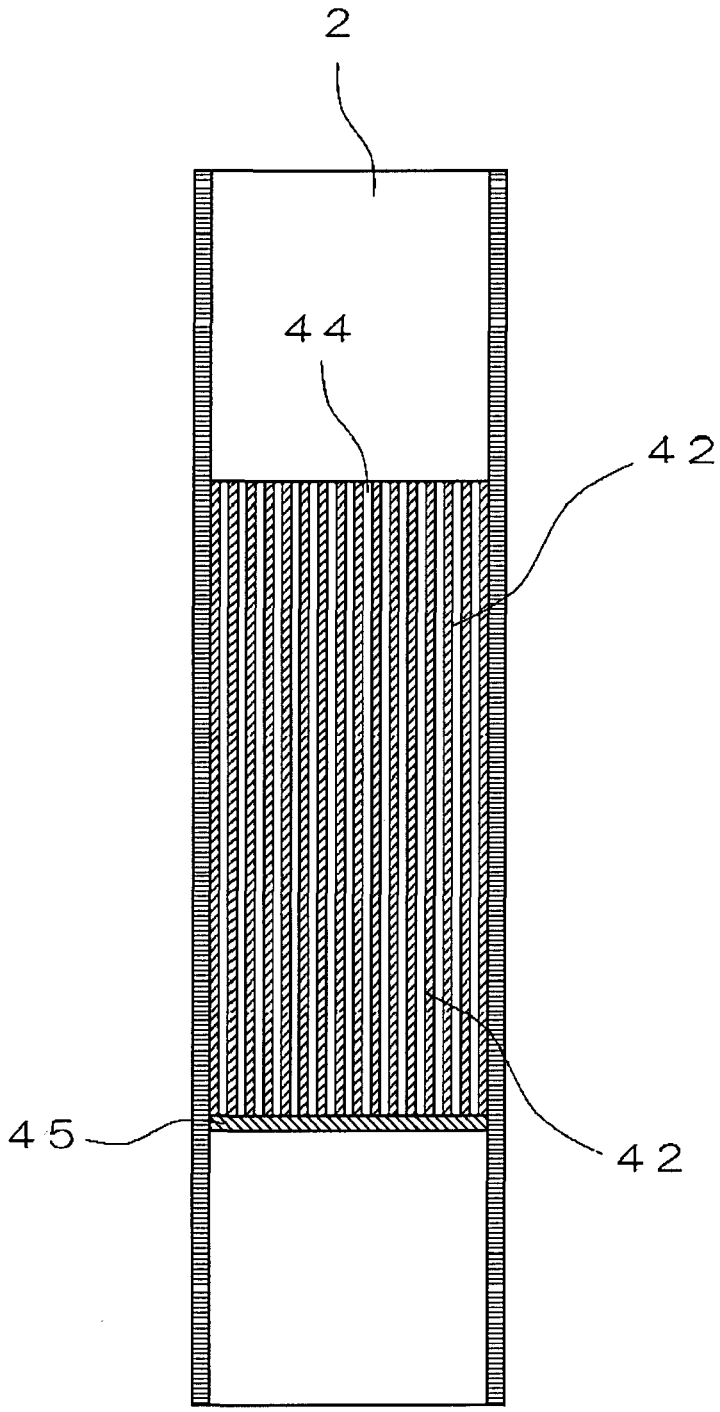
FIG. 14 is a diagram showing a second stack provided with a transmission path blocking portion in the second embodiment.
Figure 15:
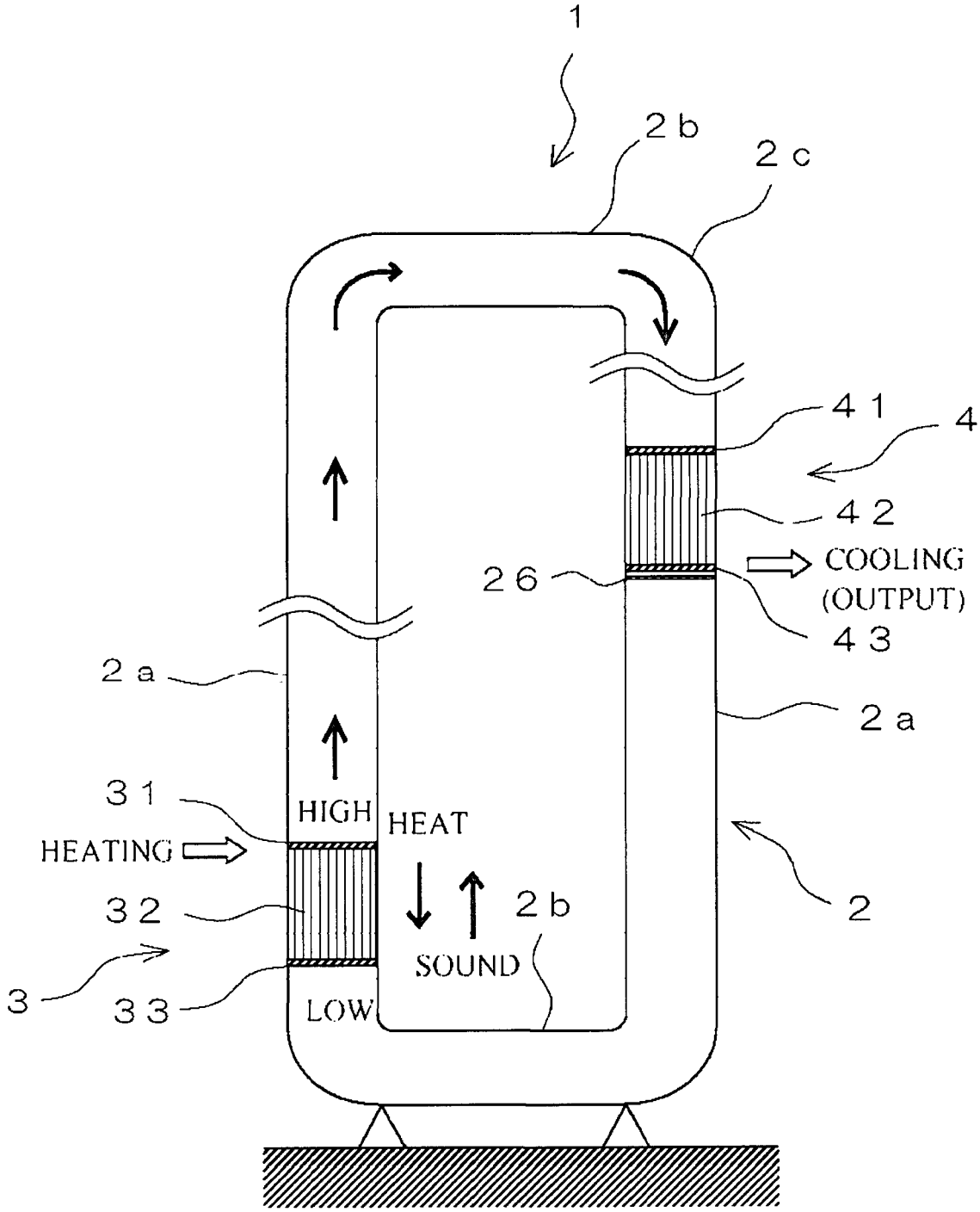
FIG. 15 is a diagram showing a configuration in which a blocking portion is disposed in a loop tube in the second embodiment.
Figure 16:
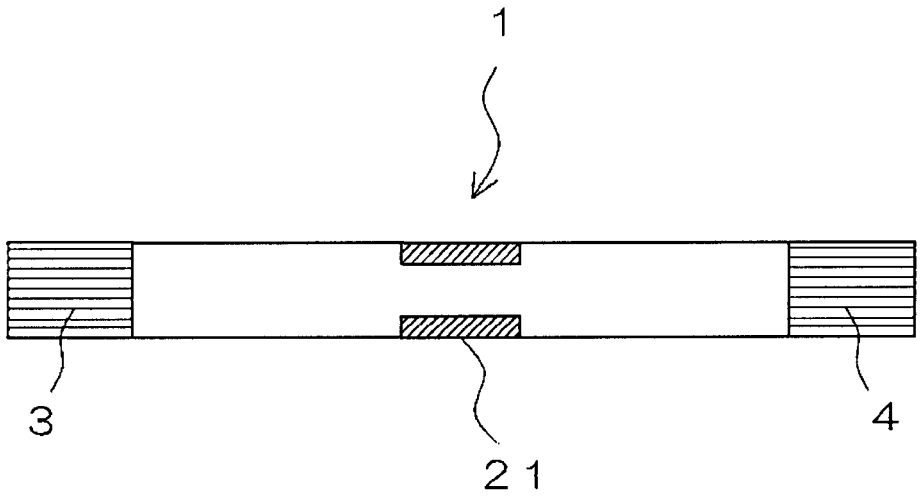
FIG. 16 is a diagram showing a thermoacoustic apparatus including a hollow member having a linear configuration in the second embodiment.
Figure 17:
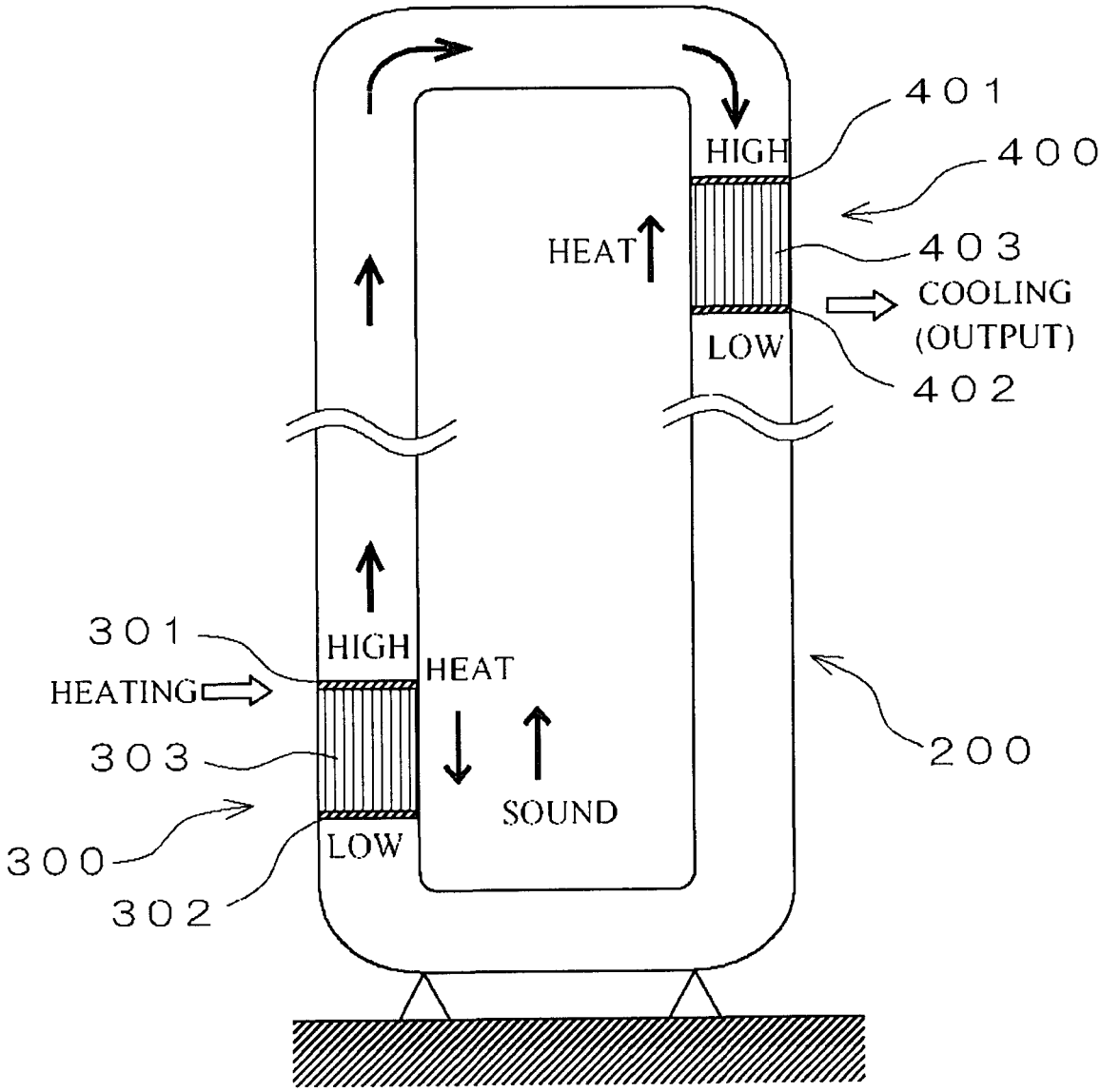
FIG. 17 shows a thermoacoustic apparatus according to the related art.
Figure 18:
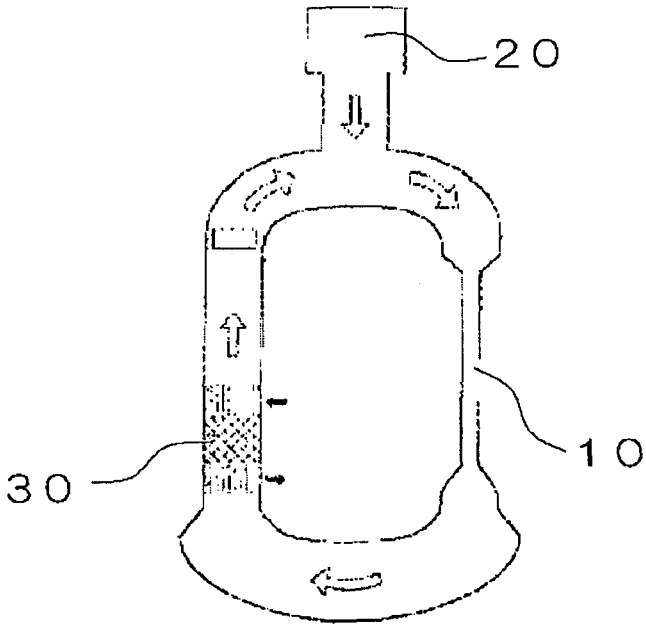
FIG. 18 shows a thermoacoustic apparatus according to the related art.

1 thermoacoustic apparatus
2 loop tube
2*a* linear tube portion
2*b* connection tube portion
2*c* arm portion
2*d* opening portion
2*e* branch tube
21 narrow portion
22 narrow path
23 slit portion
24 projection piece
25 opposite-side end portion of branch tube
26 blocking portion
3 acoustic wave generator
31 first high-temperature-side heat exchanger
32 first stack
33 first low-temperature-side heat exchanger
34 transmission path
4 acoustic heat exchanger
41 second high-temperature-side heat exchanger
42 second stack
43 second low-temperature-side heat exchanger
44 transmission path
45 transmission path blocking portion

The invention claimed is:

1. A thermoacoustic apparatus, comprising:

an acoustic wave generator for generating an acoustic wave, an acoustic heat exchanger including a pair of heat exchangers set on the high temperature side and on the low temperature side and a stack having a plurality of transmission paths in the inside, and a hollow member including the acoustic wave generator and the acoustic heat exchanger, the thermoacoustic apparatus converting acoustic energy generated in the hollow member to thermal energy by using the acoustic heat exchanger, wherein a particle velocity acceleration portion for forcedly accelerating the particle velocity of the acoustic wave by reducing the inner diameter of the hollow member is disposed at a midpoint position between the acoustic wave generator and the acoustic heat exchanger in the hollow member, wherein the particle velocity acceleration portion is configured to be slidable along the inside of the hollow member.

2. The thermoacoustic apparatus according to claim 1, wherein the hollow member is formed from a loop tube.

3. A thermoacoustic apparatus, comprising:

an acoustic wave generator for generating an acoustic wave, an acoustic heat exchanger including a pair of heat exchangers set on the high temperature side and on the low temperature side and a stack having a plurality of transmission paths in the inside, and a hollow member including the acoustic wave generator and the acoustic heat exchanger, the thermoacoustic apparatus converting acoustic energy generated in the hollow member to thermal energy by using the acoustic heat exchanger, wherein a particle velocity reduction portion for forcedly reducing the particle velocity of the acoustic wave generated in the hollow member is disposed in the vicinity of the acoustic heat exchanger in the hollow member, wherein the particle velocity reduction portion is an opening portion of a branch tube connected to the position at which the particle velocity is a minimum, wherein the particle velocity reduction portion is formed from an opening portion of a branch tube connected at the position at which the particle velocity is a minimum and the branch tube generates, in the inside, the same wavelength as an integral multiple of the one-quarter wavelength of the acoustic wave generated in the hollow member.

4. The thermoacoustic apparatus according to claim 3, wherein the particle velocity reduction portion is formed by disposing a transmission path blocking portion for blocking transmission of the working fluid in the stack.

5. The thermoacoustic apparatus according to claim 3, wherein the particle velocity reduction portion is formed from a blocking portion for blocking the hollow portion of the hollow member.

6. The thermoacoustic apparatus according to claim 3, wherein the hollow member is formed from a loop tube.

* * * * *

UNITED STATES PATENT AND TRADEMARK OFFICE

CERTIFICATE OF CORRECTION

PATENT NO. : 8,443,599 B2
APPLICATION NO. : 12/439653
DATED : May 21, 2013
INVENTOR(S) : Watanabe et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1116 days.

Signed and Sealed this
Eighth Day of September, 2015

Michelle K. Lee

Michelle K. Lee
*Director of the United States Patent and Trademark Office*